United States Patent [19]

Stephenson et al.

[11] 3,969,864

[45] July 20, 1976

[54] FIRE RESISTANT CEILING CONSTRUCTION

[75] Inventors: Fred J. Stephenson, Overland Park, Kans.; Donald J. Rush, Grandview, Mo.

[73] Assignee: Butler Manufacturing Company, Kansas City, Mo.

[22] Filed: Oct. 4, 1974

[21] Appl. No.: 512,068

[52] U.S. Cl. ..... 52/475; 52/483; 52/498

[51] Int. Cl.[2] ..... E04B 5/57; E04C 1/36

[58] Field of Search ..... 52/484, 489, 475, 655, 52/357–359, 727, 461, 494–498, 758 A, 758 C, 665, 475, 483

[56] References Cited

UNITED STATES PATENTS

| | | | |
|---|---|---|---|
| 3,053,359 | 9/1962 | Stanley | 52/484 |
| 3,055,469 | 9/1962 | Byssing et al. | 52/489 |
| 3,077,057 | 2/1963 | Forkin | 52/357 |
| 3,415,027 | 12/1968 | Snyder et al. | 52/655 |

FOREIGN PATENTS OR APPLICATIONS

| | | | |
|---|---|---|---|
| 872,542 | 6/1971 | Canada | 52/727 |
| 802,406 | 2/1951 | Germany | 52/359 |
| 849,847 | 9/1960 | United Kingdom | 52/484 |

*Primary Examiner*—Frank L. Abbott
*Assistant Examiner*—James L. Ridgill, Jr.
*Attorney, Agent, or Firm*—Shoemaker and Mattare, Ltd.

[57] ABSTRACT

A fire resistant ceiling for a building having a space grid construction comprised of a plurality of horizontally extending space trusses with bottom chords or bases thereof having oppositely directed flanges supporting fire resistant ceiling panels thereon, and grid protecting fire resistant panels secured to the space truss bottom chords between adjacent edges of the ceiling panels to protect the space trusses from fire.

8 Claims, 10 Drawing Figures

FIRE RESISTANT CEILING CONSTRUCTION

BACKGROUND OF THE INVENTION

This invention relates to fire resistant ceilings, and particularly to a fire resistant ceiling for a building in which steel structural members are utilized. In such building constructions it is important to protect the structural members from fire, since the high temperatures associated with the fire will quickly warp and destroy the structural members.

Heretofore, no direct means utilizing the ceiling structure itself has been provided to adequately protect these space trusses or structural members from the effects of fire, and accordingly, when a fire occurred, they were quickly damaged or destroyed by the high temperatures associated with the fire. In systems wherein means was provided to protect the structural members from the temperatures associated with a fire, the structure was either excessively expensive or was too complicated to be practical.

In accordance with the present invention, an exceptionally simple and economical system is provided for rendering a space grid ceiling construction fire resistant for a predetermined period of time, wherein the space grid ceiling construction includes a plurality of space trusses having bottom chords or base members with oppositely directed flanges on which ceiling panels are supported, and grid protecting fire resistant panels are secured to the space truss bottom chords beneath adjacent edges of the ceiling panels by means of economical and easy to use channel members.

Additionally, in accordance with the present invention, unique intersection covers are provided for covering the intersection between the longitudinally and transversely extending base members of the space trusses and perimeter channels are provided for protecting the space truss base members at the perimeter of the ceiling construction adjacent the side walls thereof.

Moreover, the unique intersection covers enable thermal expansion of the grid protection members or panels by allowing movement inside the intersection cover and the ceiling construction of the invention has an attractive appearance comprised of exposed white mineral fiberboard with black channels on each side and at the intersection cover.

Still further, the unique fire resistant ceiling construction of the invention allows assembly of the ceiling structure without requiring any separate fasteners and the like.

OBJECTS OF THE INVENTION

It is an object of this invention to provide a fire resistant ceiling construction for a building having a space grid construction comprised of a plurality of space trusses with bottom chords or space members on which ceiling panels are supported, and wherein unique grid protection means is provided for covering the exposed portions of the base members at adjacent edges of the ceiling panels to thus protect the space grid construction from the high temperatures associated with a fire at least for a predetermined period of time.

Another object of this invention is to provide a fire resistant ceiling construction which affords protection to metallic structural members in the ceiling for predetermined period of time, and wherein the ceiling construction utilizes fire resistant panels and fastening means which are quickly and easily clipped into position without requiring the use of separate fasteners and the like.

DETAILED DESCRIPTION OF THE INVENTION

Figure 1:
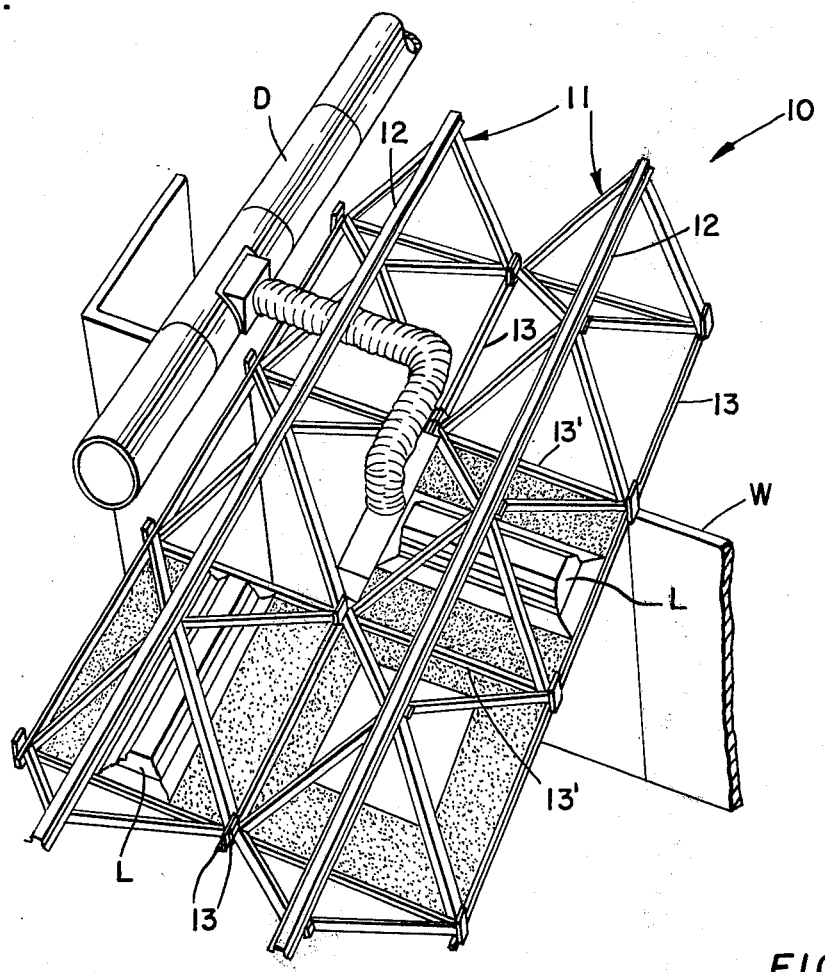
FIG. 1 is a top perspective fragmentary view of a portion of a ceiling construction of the space grid type utilizing a plurality of space trusses.

A portion of a building construction of the space grid type is indicated generally at 10 in FIG. 1 and comprises a plurality of space trusses 11 having roof supporting top chords 12 and ceiling supporting bottom chords 13.

Figure 3:
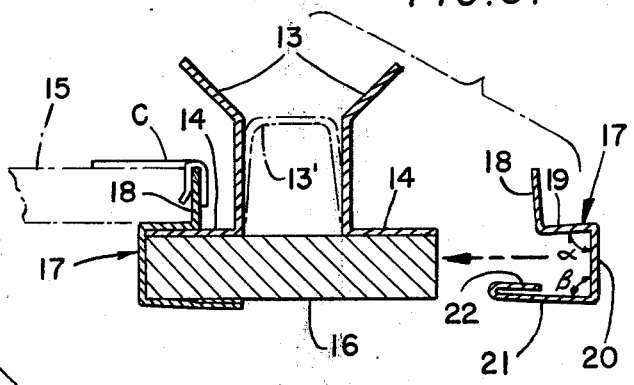
FIG. 3 is a view similar to FIG. 2 illustrating the manner in which the fastening clip or channel of the grid protecting panel is secured in position.
Figure 2:
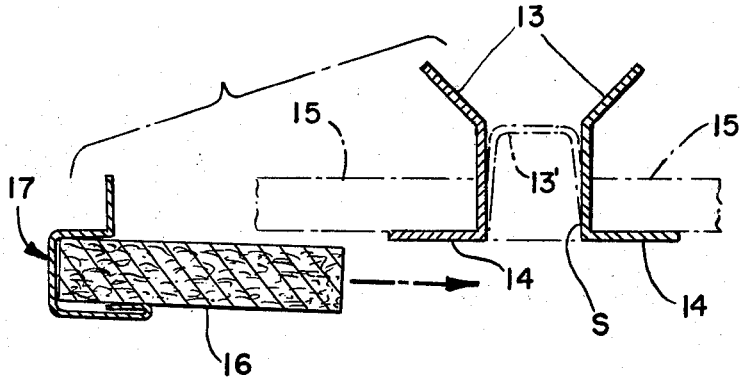
FIG. 2 is a fragmentary exploded view in section showing the manner in which a grid protecting panel is placed in operative association with the bottom chords or base members of a space truss.

As seen in FIGS. 2 and 3, the bottom chords or base members 13 have outwardly directed, horizontally extending flanges 14 thereon, on which suitable ceiling panels 15 are supported at their opposite edges. These ceiling panels are fire resistant. As seen clearly in FIGS. 2 and 3, the base members 13 between adjacent space trusses are spaced apart, thus leaving a space S therebetween through which fire and heat could readily pass to the space or area above the ceiling panels 15 and consequently damage or destroy the metal structural members or trusses. It should be noted that the longitudinally extending base members are designated as 13 and are shown in full lines in FIGS. 2 and 3, whereas the transversely extending base members have a configuration as indicated at 13' in phantom lines in FIGS. 2 and 3.

Thus, with conventional constructions, it is readily apparent that when the ceiling panels 15 are positioned on the flanges 14 of the base members, the base members themselves are exposed to the effect of fire and would, therefore, be quickly damaged or destroyed by the high temperature associated with the fire.

Therefore, in accordance with the present invention, fire resistant grid protecting panels 16 are quickly and easily secured in position beneath the base members 13 by means of unique attaching clips or channels 17, thus covering the exposed structural base members with thermal protective material and contributing to the integrity of the fire protection provided by the ceiling components.

Figure 10:
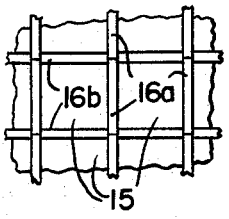
FIG. 10 is a fragmentary view looking up toward a portion of a ceiling constructed in accordance with the invention, with the intersection covers omitted.
Figure 4:
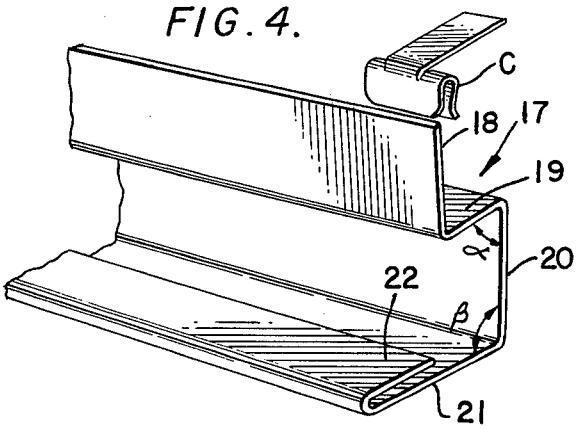
FIG. 4 is a fragmentary perspective view of the grid channel or clip for securing the grid protecting panel in place.

In a preferred construction, the grid protecting panels 16 comprise a white mineral fiberboard and all are approximately three inches wide, and panels 16*a* applied to the longitudinally extending base members 13 are approximately sixty inches long, and panels 16*b* as applied to the transversely extending base members 13' are approximately fifty-seven inches long. Thus, as seen in FIG. 10, the shorter panels abut the longer panels and effectively shield the base members.

The channel clips or fasteners 17 preferably comprise 26 gauge steel prepainted black, and have an upwardly extending vertical flange or wall 18 approximately ⅝ of an inch high joined at its bottom to a horizontally extending flange or wall 19 approximately 9/16 of an inch wide, which is in turn joined with a downwardly extending wall 20 at an angle $\alpha$ of approximately 88°, the wall 20 having a width of about ¾ of an inch. The wall 20 is in turn connected at its bottom edge with a second horizontally extending wall or bottom flange 21 at an angle $\beta$ of 85° and the wall 21 is about 15/16 of an inch wide. The outer or free edge of bottom wall 21 is turned reversely upon itself at 22 for a distance of approximately ⅜ of an inch. With the clip as thus formed, the top and bottom walls 19 and 21 and the reversely extending portion 22 at the free edge of bottom wall 21 afford a resilient clamping action against the edge of the grid protecting panels 16 to securely clamp the panels 16 to the horizontally extending flanges 14 of the base members of the space trusses.

In assembling the ceiling construction of the invention, a clip or channel 17 is first applied or attached to one edge of a grid protecting panel 16, as seen in FIG. 2, and the channel and panel are then positioned with a flange 14 of one base member 13 received the top wall 19 and bottom wall 21 of the channel 17 and a second channel 17 is then inserted or positioned over the flange 14 and edge of panel 16 at the opposite side of the base member 13, as in FIG. 3. Ceiling panels 15 are subsequently positioned with their opposite edges lying on top of the top walls 19 of the channels 17 and their edges abutted against the upwardly extending flanges or walls 18 thereof. A spring clip C, having a pair of spaced, downwardly extending, yieldable legs and a horizontal tab, is positioned over the wall 18 to hold the panels 15 downwardly on the supports, as seen in FIG. 3.

Figure 5:
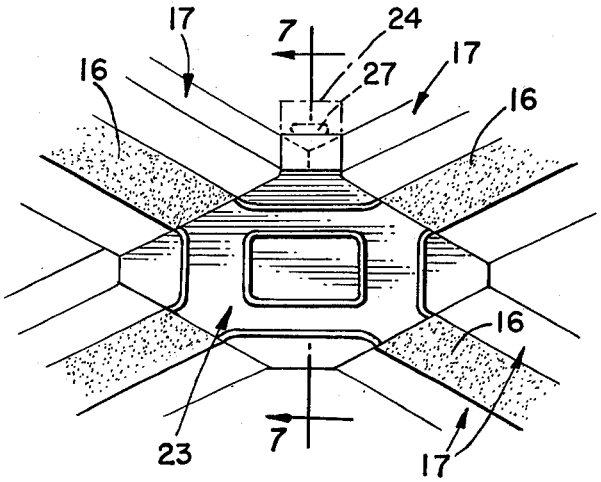
FIG. 5 is a bottom perspective view of the intersection cover of the invention.
Figure 6:
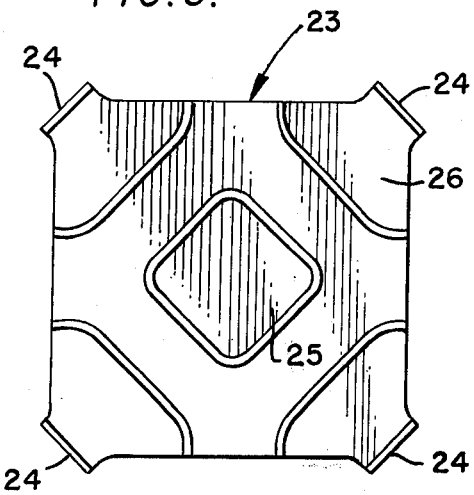
FIG. 6 is an enlarged plan view of the intersection cover of FIG. 5.
Figure 7:
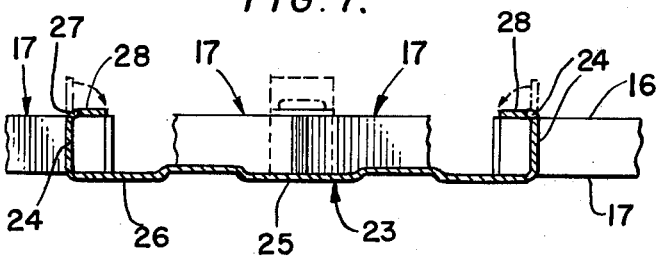
FIG. 7 is an enlarged view in section with portions broken away of the intersection cover in FIG. 5.

A unique intersection cover 23 is provided at the intersection of the longitudinal and transverse base members, as seen in FIG. 5, to cover the joint at the intersection between the grid protecting panels 16*a* and 16*b*. The intersection cover 23 is substantially rectangular in configuration and has an upstanding integral tab 24 at each of the opposite corners thereof. The intersection cover has vertically offset center and corner portions 25 and 26, which not only reinforce the intersection cover, but impart an attractive appearance thereto. Each of the corner tabs 24 has a horizontally extending slot 27 therein which defines a weakened area between the ends of the tabs whereby the upper end 28 of the tab may be easily bent downwardly over the adjacent corner portions of the grid protecting panels 16 and the grid panel attaching channels 17.

In a preferred construction, the intersection covers 23 also comprise 26 gauge steel prepainted black and the tabs are approximately 1-13/16 inches long and ¾ of an inch wide, and the cover is about four inches square.

Figure 8:
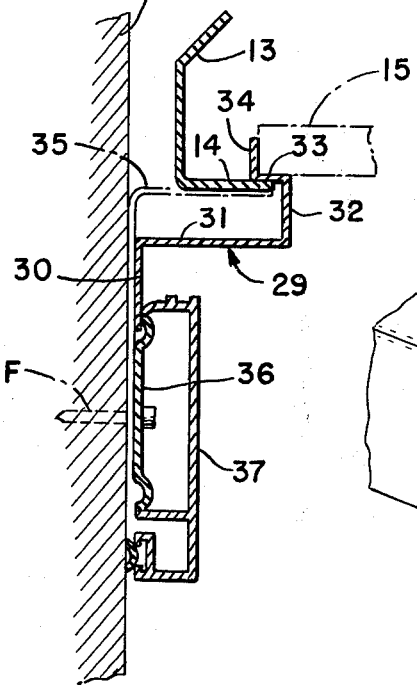
FIG. 8 is an enlarged fragmentary view in section of a portion of a perimeter of a building construction showing the perimeter channel of the invention.
Figure 9:
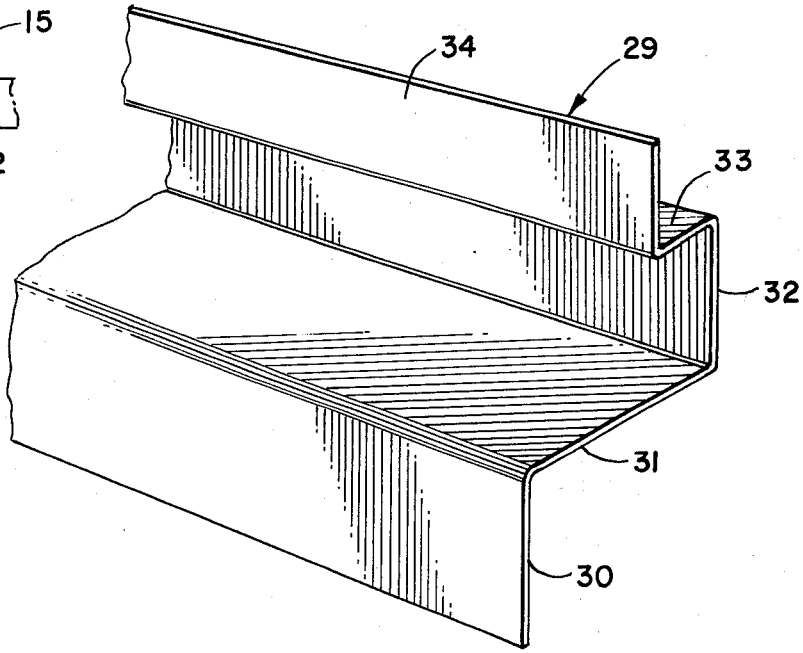
FIG. 9 is an enlarged, fragmentary, perspective view of the perimeter channel of FIG. 8.

In FIGS. 8 and 9, a perimeter channel 29 comprises a downwardly extending wall or flange 30, a horizontally extending wall or flange 31 and a vertically extending wall 32, with a horizontally offset portion 33 at its upper edge and a vertically extending flange 34. The perimeter channel 29 is utilized at the perimeter of a ceiling structure adjacent a wall W, and the horizontal and vertical flanges 33 and 34 are positioned over the flange 14 of a space truss base member 13 for receiving a ceiling panel 15, and the downwardly extending wall 30 of the perimeter channel 29 is received between a wall header angle 35, if one is provided, and a trim clip 36, which is attached to the wall with a suitable fastener means F. Suitable trim 37 is clipped or snap fitted to the trim clip 36 in a conventional manner. Thus, the perimeter channel 29 affords protection of the space truss base member 13 at the perimeter of the ceiling construction and also provides an attractive appearance or trim item at the perimeter of the ceiling.

The perimeter channel, in a preferred construction, also comprises 26 gauge steel prepainted black and is approximately 60 inches long, and the wall portion 31 is approximately 1-7/16 inches wide.

Thus by means of the present invention, a ceiling may be quickly and easily constructed and assembled which is both economical and fire resistant, and a ceiling constructed in accordance with the invention effective resists the effects of a fire for approximately one hour, thus affording ample time to control the fire before structural damage to the space trusses results.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well conjointly cooperative equivalents are, therefore, intended to be embraced by those claims.

We claim:

1. A fire resistant space grid ceiling system, comprising: a plurality of steel space trusses arranged to form a rectangular space grid ceiling construction, said trusses having base members with opposite, horizontally outwardly extending flanges thereon; rectangularly shaped, fire resistant ceiling panels supported at their opposite edges on top of said flanges in spanning relationship to adjacent base members and leaving exposed therebeneath a lower portion of the base members; rectangularly shaped, fire resistant grid protecting panels having a width substantially the same as the width of the exposed portion of the base members and secured to the underside of the flanges of the base members; and separate, elongate channel members having a generally vertical wall with top and bottom edges and generally horizontal top and bottom walls on the top and bottom edges of the vertical wall, the bottom wall thereof engaged under an adjacent edge of the grid protecting panel and the top wall thereof engaged directly over and against an adjacent flange of a base member, the channel members having a length substantially the same as the length of the panel members, to readily releasably attach the grid protecting panel members in position against the underside of the base members to protect the base members from heat and fire.

2. A fire resistant space grid ceiling system as in claim 1, wherein a perimeter channel is connected between adjacent wall trim and an adjacent base member of a space truss at the perimeter of a ceiling to protect the base member from fire, said perimeter channel having a horizontal wall with a depending flange at one edge thereof received between one wall trim and the wall, and a vertical wall at the other edge thereof extending upwardly to approximately the level of the flange of the base member, the upper edge of the vertical wall having a horizontal flange lying over the top of the flange of the base member and a vertical flange extending upwardly therefrom and against which the edge of a ceiling panel is abutted.

3. A fire resistant space grid ceiling system as in claim 1, wherein the grid protecting panels comprise white mineral fiberboard.

4. A fire resistant space grid ceiling system as in claim 1, wherein grid panel intersection covers are secured to the grid protecting panels therebeneath at the intersections of the panels with one another at the juncture of transversely extending and longitudinally extending base members of the space trusses.

5. A fire resistant space grid ceiling system as in claim 4, wherein the intersection covers each comprises a substantially rectangularly shaped plate having an upstanding bendable tab at each of the four corners thereof, said plate being engaged against the bottom end surface portions of the grid protecting panels and the tabs being bent horizontally at their upper ends over the top end surface portions of the grid protecting panels.

6. A fire resistant space grid ceiling system as in claim 5, wherein the bendable tabs each have a transverse slot therein defining a weakened area about which the tab is bent with the upper end of the tab disposed against the adjacent upper surface of the grid protecting panel.

7. A fire resistant space grid ceiling system as in claim 4, wherein said top and bottom walls have an at-rest position deflected inwardly toward one another, and when in use being resiliently deflected outwardly to thus impart a resilient clamping action on the adjacent grid protecting panel.

8. A fire resistant space grid ceiling system as in claim 7, wherein a vertically upward extending flange is on the top wall of the channel, and the adjacent edge of a ceiling panel abuts against said vertically extending flange, and the free edge of the bottom wall is bent reversely upon itself to define a yieldable panel engaging means to enhance the gripping action of the channel on an associated panel.

* * * * *